US006219080B1

(12) United States Patent
Imai

(10) Patent No.: US 6,219,080 B1
(45) Date of Patent: Apr. 17, 2001

(54) THICK FILM THERMAL HEAD

(75) Inventor: Ryoichi Imai, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/598,363

(22) Filed: Jun. 21, 2000

(30) Foreign Application Priority Data

Jun. 22, 1999 (JP) ..... 11-175552

(51) Int. Cl.[7] ..... B41J 2/345
(52) U.S. Cl. ..... 347/208
(58) Field of Search ..... 347/200, 208

(56) References Cited

U.S. PATENT DOCUMENTS 4,048,470 * 9/1977 Shindo et al. ..... 347/208
4,549,189 * 10/1985 Shiratsuki ..... 347/208
4,559,542 * 12/1985 Mita ..... 347/208

* cited by examiner

*Primary Examiner*—Huan Tran
(74) *Attorney, Agent, or Firm*—Nixon Peabody LLP; Donald R. Studebaker

(57) ABSTRACT

A thick film thermal head includes a plurality of first and second electrodes which extend in a sub-scanning direction and are alternately arranged in a main scanning direction intersecting the sub-scanning direction at predetermined spaces. A resistance heater continuously extends in the main scanning direction across the first and second electrodes. Parts of the resistance heater between adjacent first and second electrodes form a plurality of resistance heater elements which are arranged in the main scanning direction and generate heat when energized through the first and second electrodes. The spaces between the first and second electrodes are smaller than the widths of the first and second electrodes in the main scanning direction.

5 Claims, 5 Drawing Sheets

PRIOR ART

THICK FILM THERMAL HEAD

BACKGROUND OF THE INVENTION

1. Field of the Invention

This invention relates to a thick film thermal head for making a heat-sensitive stencil master.

2. Description of the Related Art

Thermal heads for making a heat-sensitive stencil master generally comprise an array of resistance heater elements and imagewise perforate a stencil master material by selectively energizing the heater elements and are broadly classified into thin film thermal heads and thick film thermal heads by the structure.

FIG. 9 shows an example of a conventional thick film thermal head. In FIG. 9, the conventional thick film thermal head comprises a ceramic substrate 95, a heat insulating layer 92 formed on the ceramic substrate 95, a plurality of comb-tooth electrodes 94 which are formed on the heat insulating layer 92 and arranged in a row in a direction perpendicular to their longitudinal directions, and a resistance heater 91 which extends in the direction of the row of the comb-tooth electrodes 94. The resistance heater 91 is formed over the comb-tooth electrodes 94 to continuously extend across the electrodes 94. With this arrangement, when an electric voltage is applied across a pair of adjacent electrodes, the part of the resistance heater 91 between the electrodes 94 generates heat. That is, parts 91*a* of the resistance heater 91 between adjacent electrodes 94 form resistance heater elements. The resistance heater elements 91*a* are arranged in the direction of the row of the comb-tooth electrodes 94. This direction will be referred to as "the main scanning direction", hereinbelow.

When making a stencil master by a thermal head, it is generally necessary to form, on a stencil master material 71, perforations 72 which are separated from each other in both the main scanning direction X and the sub-scanning direction Y (the direction substantially perpendicular to the main scanning direction) as shown in FIG. 7.

If the perforations 72 are continuous in the main scanning direction X as shown in FIG. 8, ink is supplied to the printing paper through the perforations in an excessive amount, which results in offset and/or strike through.

If each of the resistance heater elements 91*a* is thermally insulated from the parts of the resistance heater 91 on opposite sides of the resistance heater element 91*a* in FIG. 9, the width W in the main scanning direction of the area which generates heat when the element 91*a* is energized will be substantially equal to the space P between adjacent electrodes 94.

However, actually each of the resistance heater elements 91*a* is not thermally insulated from the parts of the resistance heater 91 on opposite sides of the resistance heater element 91*a*, and accordingly, heat generated from each resistance heater element 91*a* propagates to the part adjacent thereto, whereby, as shown in FIG. 10, an area 101 wider than the resistance heater element 91*a*, or the space P between adjacent electrodes 94, becomes hot. When adjacent two resistance heater elements 91*a* are simultaneously energized, the actual heat generating areas 101 of the adjacent resistance heater elements 91*a* become closer to each other as shown in FIG. 10, which can result in continuous perforations.

Especially in the case of a thick film thermal head, since the resistance heater 91 is large in thickness, heat generated from each resistance heater element 91*a* spreads over a wide area while it propagates to the surface of the element 91*a* and the width W of the heat generating area more tends to become larger than the space P between the electrodes 94 at the surface of the resistance heater 91. Accordingly, in the case of a thick film thermal head, the aforesaid problem is more serious.

SUMMARY OF THE INVENTION

In view of the foregoing observations and description, the primary object of the present invention is to provide a thick film thermal head which can form perforations which are separated from each other in the main scanning direction without thermally insulating the resistance heater elements from each other.

The thick film thermal head in accordance with the present invention comprises a plurality of first and second electrodes which extend in a sub-scanning direction and are alternately arranged in a main scanning direction intersecting the sub-scanning direction at predetermined spaces, and a resistance heater which continuously extends in the main scanning direction across the first and second electrodes, parts of the resistance heater between adjacent first and second electrodes forming a plurality of resistance heater elements which are arranged in the main scanning direction and generate heat when energized through the first and second electrodes, and is characterized in that the spaces between the first and second electrodes are smaller than the widths of the first and second electrodes in the main scanning direction.

It is preferred that the spaces between the first and second electrodes are smaller than the width of the resistance heater in the sub-scanning direction.

It is preferred that the width of the resistance heater in the sub-scanning direction is smaller than the perforation pitches in the main scanning direction.

The first and second electrodes are preferably formed of metal having a thermal conductivity not lower than 100 W/mK at 100° C. For example, the electrodes may be formed of silver (422 W/mK in thermal conductivity and 2.08 ρ/Ωm in resistivity at 100° C.), copper (395 W/mK in thermal conductivity and 2.23 ρ/Ωm in resistivity at 100° C.), gold (313 W/mK in thermal conductivity and 2.88 ρ/Ωm in resistivity at 100° C.), aluminum (240 W/mK in thermal conductivity and 7.8 ρ/Ωm in resistivity at 100° C.), beryllium (168 W/mK in thermal conductivity and 5.3 ρ/Ωm in resistivity at 100° C.), tungsten (163 W/mK in thermal conductivity and 7.3 ρ/Ωm in resistivity at 100° C.), magnesium (154 W/mK in thermal conductivity and 5.3 ρ/Ωm in resistivity at 100° C.), iridium (145 W/mK in thermal conductivity and 6.8 ρ/Ωm in resistivity at 100° C.), molybdenum (135 W/mK in thermal conductivity and 7.6 ρ/Ωm in resistivity at 100° C.), brass (128 W/mK in thermal conductivity and 6.3 ρ/Ωm in resistivity at 100° C.), or zinc (112 W/mK in thermal conductivity and 7.8 ρ/Ωm in resistivity at 100° C.).

It is preferred that a radiator for dissipating heat of the electrodes is provided in a close contact with the electrodes.

In the thick film thermal head of the present invention, since the spaces between the first and second electrodes are smaller than the widths of the first and second electrodes in the main scanning direction, that is, since the widths of the resistance heater elements are smaller than the widths of the electrodes, which have a heat dissipation effect, the heat generated by the resistance heater elements is effectively dissipated through the electrodes. Accordingly, the widths in the main scanning direction of the heat generating areas which become hot when the resistance heater elements are energized can be approximated to the spaces between the electrodes, whereby perforations formed in the stencil master material adjacent to each other can be surely separated from each other and offset and/or strike through can be effectively prevented.

When the resistance heater elements are larger in width in the main scanning direction (the spaces between the first and second electrodes) than width in the sub-scanning direction (the width of the resistance heater in the sub-scanning), heat are more apt to spread in the main scanning direction. Accordingly, when the spaces between the first and second electrodes are smaller than the width of the resistance heater in the sub-scanning direction, adjacent perforations can be more surely separated from each other.

Further, when the picture element density in the sub-scanning direction is not lower than that in the main scanning direction, perforations can be prevented from being continuous in the sub-scanning direction by making the width of the resistance heater in the sub-scanning direction smaller than the perforation pitches in the main scanning direction.

Further when the electrodes are formed of metal having a thermal conductivity not lower than 100 W/mK at 100° C., the electrodes can contribute to dissipation of heat and prevention of excessive heat accumulation in the resistance heater.

DESCRIPTION OF THE PREFERRED EMBODIMENTS

Figure 1:
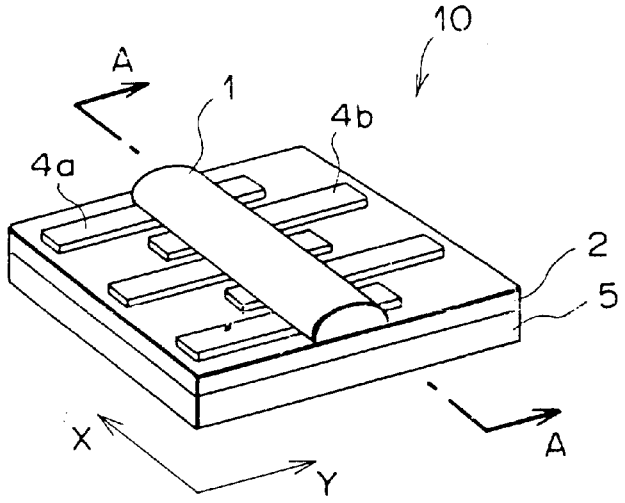
FIG. 1 is a fragmentary perspective view showing a part of a thick film thermal head in accordance with a first embodiment of the present invention.
Figure 2:
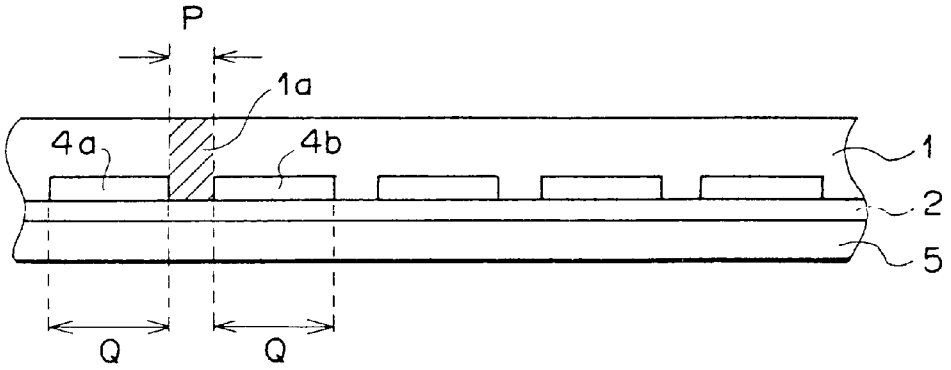
FIG. 2 is a cross-sectional view taken along line A—A in FIG. 1.

In FIGS. 1 to 4, a thick film thermal head 10 in accordance with a first embodiment of the present invention comprises a ceramic substrate 5, a heat insulating layer 2 formed on the ceramic substrate 5, a plurality of first and second electrodes 4*a* and 4*b* which are alternately formed on the heat insulating layer 2 and arranged in a row in a main scanning direction X (a direction perpendicular to their longitudinal directions), and a resistance heater 1 which extends in the main scanning direction X. The resistance heater 1 is semi-cylindrical in cross-section and is formed over the first and second electrodes 4*a* and 4*b* to continuously extend across the electrodes 4*a* and 4*b* in contact therewith. With this arrangement, when an electric voltage is applied across a pair of first and second electrodes 4*a* and 4*b*, the part of the resistance heater 1 between the electrodes 4*a* and 4*b* generates heat. That is, parts 1*a* of the resistance heater 1 between adjacent electrodes 4*a* and 4*b* form resistance heater elements. The resistance heater elements 1*a* are arranged in the direction of the main scanning direction. Reference numeral 9 in FIG. 4 denotes an equivalent circuit for the resistance heater element 1*a*. The space P between each pair of first and second electrodes 4*a* and 4*b* is smaller than the width Q in the main scanning direction of the electrodes 4*a* and 4*b*. The electrodes 4*a* and 4*b* are the same in the width Q in the main scanning direction. The first and second electrodes 4*a* and 4*b* may be formed of metal high in thermal conductivity such as silver paste, aluminum, copper, or gold, and is preferably 0.5 to 10 ρm in thickness. When the resolution is to be 400 dpi, the width Q of the electrodes 4*a* and 4*b* is preferably 30 to 50 μm, and more preferably 40 to 45 μm. The space P between the electrodes 4*a* and 4*b* is preferably 5 to 30 m, and more particularly 15 to 25 μm. For example, when the resolution is 400 dpi, the center-to-center pitch of the first and second electrodes is 63.5 μm. Accordingly, when the width Q of the electrodes 4*a* and 4*b* is set at 40 mm, the space P between the electrodes 4*a* and 4*b* can be 23.5 μm. The resistance heater 1 may be formed, for instance, by coating a paste-like mixture of ruthenium oxide powder, glass powder and a solvent over the electrodes 4*a* and 4*b* by screen printing. If necessary, the surfaces of the resistance heater 1 and the electrodes 4*a* and 4*b* may be covered with wear-resistant coating (e.g., of glass material in thickness of 2 to 20 μm).

Figure 3:
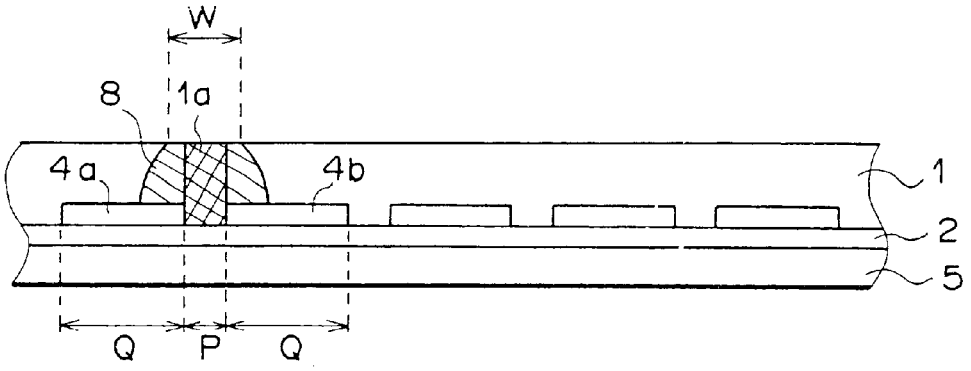
FIG. 3 is a schematic view showing a heat generating area for each resistance heater elements in the thermal head of the first embodiment.

When adjacent first and second electrodes 4*a* and 4*b* are energized, the resistance heater elements 1*a* therebetween generates heat. Due to a large thickness of the heater 1, the heat generated from the resistance heater element 1*a* spreads over a wide area while it propagates to the surface of the element 1*a* and the width W of the effective heat generating area 8 becomes larger than the width of the heater element 1*a*, i.e., the space P between the electrodes 4*a* and 4*b*, as shown in FIG. 3. However, in this embodiment, since the widths Q in the main scanning direction of the electrodes 4*a* and 4*b* are larger than the space P between the electrodes 4*a* and 4*b*, the heat is dissipated through the electrodes 4*a* and 4*b* as indicated by arrows in FIG. 4 and the effective heat generating area 8 can be confined in a relatively narrow area. Further since the parts of the effective heat generating area 8 projecting over the electrodes 4*a* and 4*b* cannot be heated to a temperature sufficient to thermally perforate the stencil master material, the width in the main scanning direction of the perforations formed can be substantially equal to the space P between the electrodes 4*a* and 4*b* and accordingly the perforations can be surely separated from each other in the main scanning direction.

Figure 4:
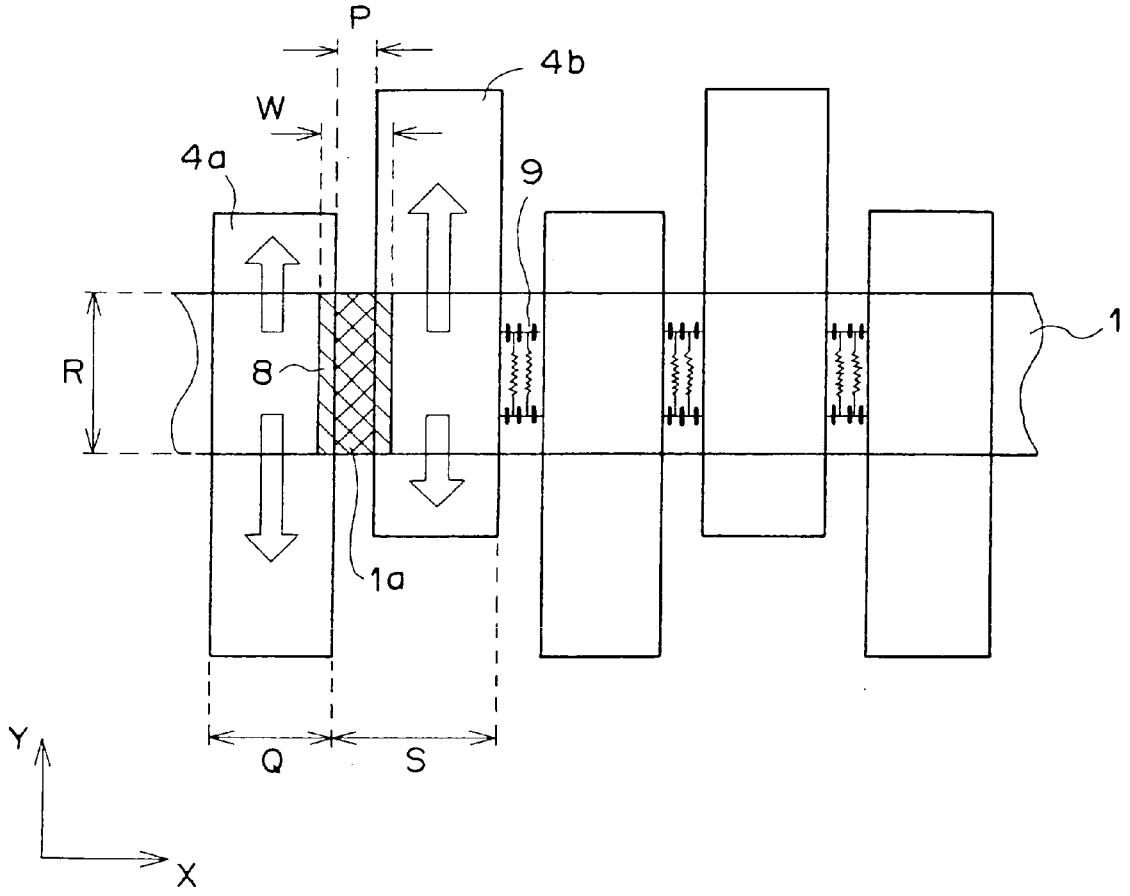
FIG. 4 is a plan view of the thermal head shown in FIG. 1.

Further, in this particular embodiment, the space P between the first and second electrodes 4*a* and 4*b*, i.e., the width W in the main scanning direction X of the resistance heater elements 1*a*, is smaller than the width R in the sub-scanning direction Y of the resistance heater 1 or the resistance heater elements 1*a* as clearly shown in FIG. 4. When the former is larger than the latter, the heat is more apt to propagate in the main scanning direction and the effective heat generating area 8 is apt to be enlarged in the main scanning direction.

Further, in this particular embodiment, the width R in the sub-scanning direction Y of the resistance heater 1 is smaller than the perforation pitches S in the main scanning direction X as clearly shown in FIG. 4. This is because if the former is larger than the latter, perforations are apt to be continuous in the sub-scanning direction Y when the picture element density in the sub-scanning direction Y is not lower than that in the main scanning direction X.

Figure 5:
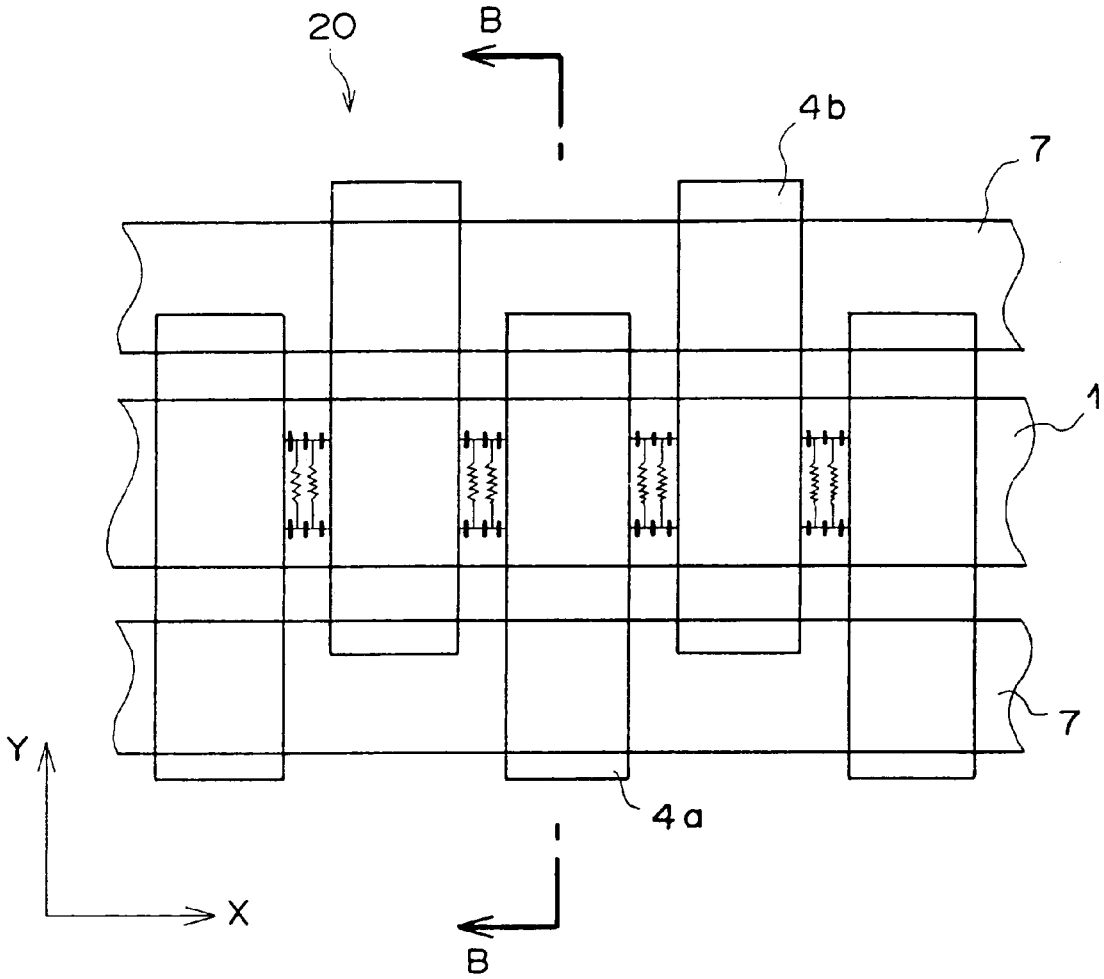
FIG. 5 is a plan view showing a thermal head in accordance with a second embodiment of the present invention.
Figure 6:
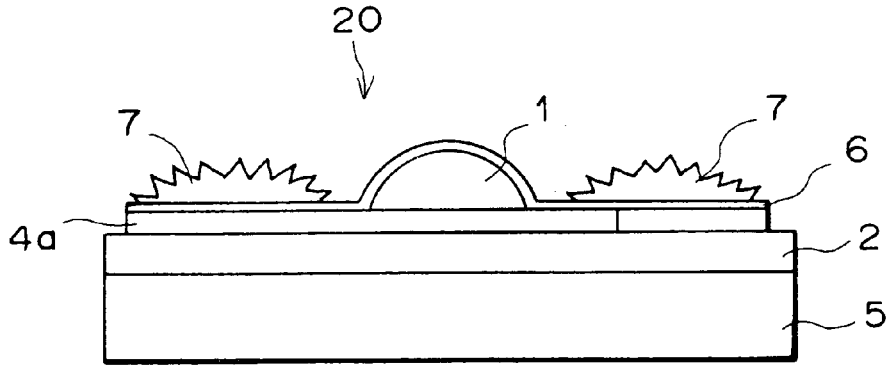
FIG. 6 is a cross-sectional view taken along line B—B in FIG. 5.
Figure 7:
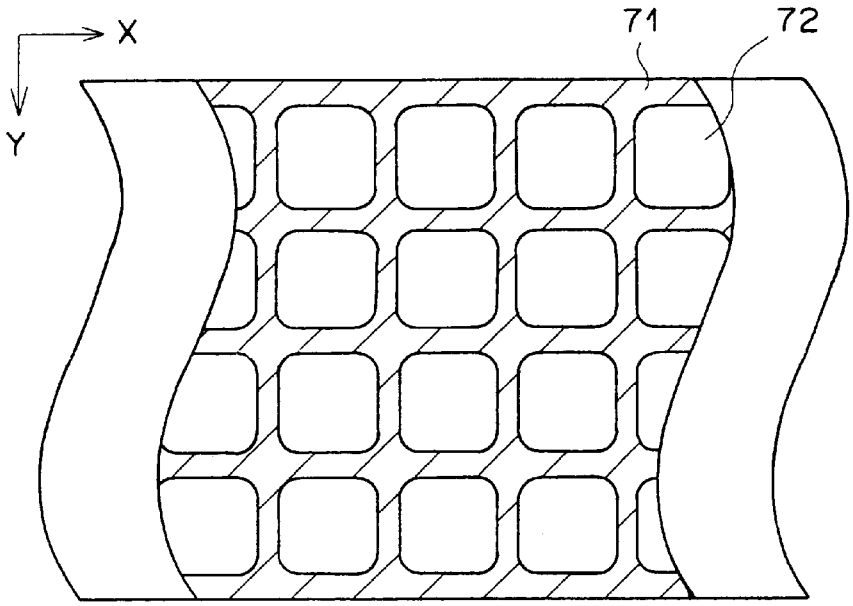
FIG. 7 is a view showing a stencil master in which perforations are regularly separated from each other.
Figure 8:
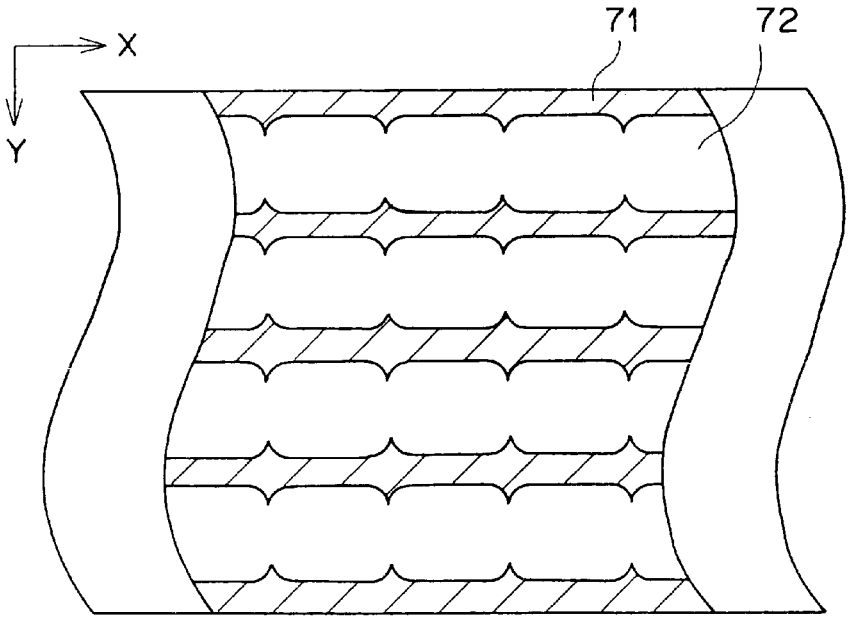
FIG. 8 is a view showing a stencil master in which perforations are continuous in the main scanning direction.
Figure 9:
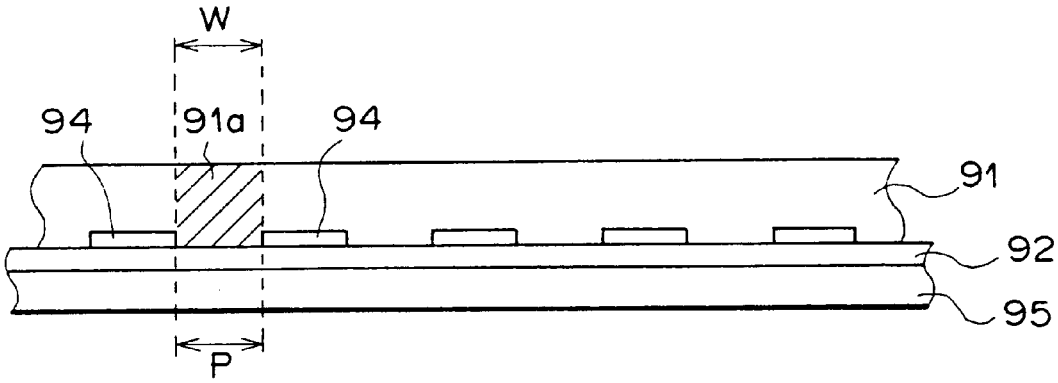
FIG. 9 is a cross-sectional view taken in the main scanning direction of a conventional thick film thermal head.
Figure 10:
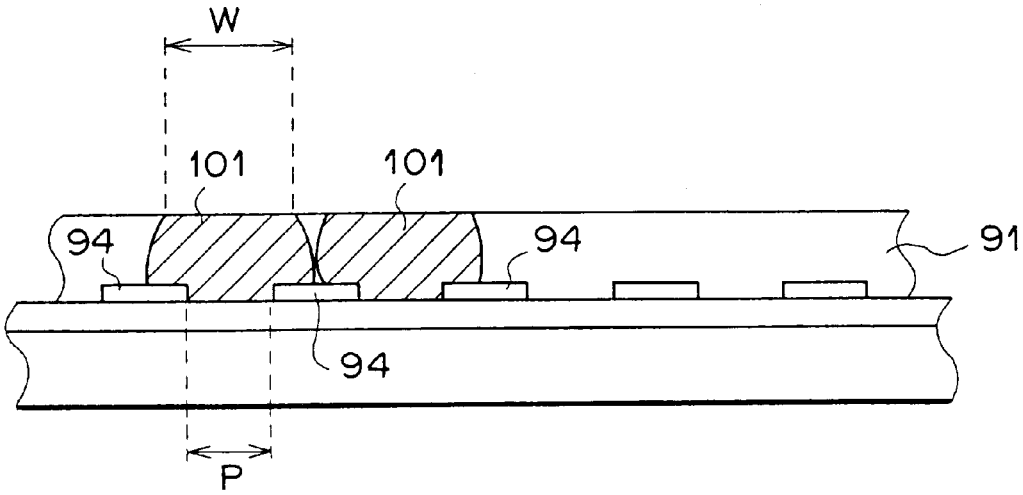
PRIOR ART FIG. 10
FIG. 10 is a schematic view showing a heat generating area for each resistance heater elements in the conventional thermal head shown in FIG. 9.

A thick film thermal head 20 in accordance with a second embodiment of the present invention where a radiator for dissipating heat of the electrodes is provided will be described with reference to FIGS. 5 and 6, hereinbelow. In FIGS. 5 and 6, the elements analogous to those shown in FIGS. 1 to 4 are given the same reference numerals and will not be described here.

The thermal head 20 of this embodiment differs from the thermal head 10 of the first embodiment in that a pair of radiators 7 for dissipating heat of the electrodes 4*a* and 4*b* are provided on opposite sides of the heater 1 near the heater 1. Each radiator 7 extends in the main scanning direction X in a close contact with the electrodes 4*a* and 4*b* with an insulating layer 6 intervening between the electrodes 4*a* and 4*b* and the radiators 7 so that the electrodes 4*a* and 4*b* are not short-circuited. The insulating layer 6 may be, for instance, of glass and may be about 1 to 20 $\mu$m in thickness. It is preferred that the radiator 7 be as large as possible in surface area so that heat can be effectively dissipated. For example, it is preferred that the radiator 7 be provided with fins or a plurality of grooves. Further, it is preferred that the radiator be formed of a material which is high in thermal conductivity. Though the electrodes 4*a* and 4*b* are in contact with the radiator 7 longer on one side of the heater 1 than on the other side of the same in the embodiment shown in FIG. 5, the electrodes 4*a* and 4*b* may extend beyond the radiator 7 on both sides of the heater 1.

What is claimed is:

1. A thick film thermal head comprising a plurality of first and second electrodes which extend in a sub-scanning direction and are alternately arranged in a main scanning direction intersecting the sub-scanning direction at predetermined spaces, and a resistance heater which continuously extends in the main scanning direction across the first and second electrodes, parts of the resistance heater between adjacent first and second electrodes forming a plurality of resistance heater elements which are arranged in the main scanning direction and generate heat when energized through the first and second electrodes, wherein the improvement comprises that the spaces between the first and second electrodes are smaller than the widths of the first and second electrodes in the main scanning direction.

2. A thick film thermal head as defined in claim 1 in which the spaces between the first and second electrodes are smaller than the width of the resistance heater in the sub-scanning direction.

3. A thick film thermal head as defined in claim 1 in which the width of the resistance heater in the sub-scanning direction is smaller than the perforation pitches in the main scanning direction.

4. A thick film thermal head as defined in claim 1 in which said first and second electrodes are formed of metal having a thermal conductivity not lower than 100 W/mK at 100° C.

5. A thick film thermal head as defined in claim 1 further comprising a radiator for dissipating heat of the electrodes provided in a close contact with the electrodes.

* * * * *